US008484919B2

(12) United States Patent
Brunedal et al.

(10) Patent No.: US 8,484,919 B2
(45) Date of Patent: Jul. 16, 2013

(54) TRANSITIONS HAVING DISPARATE SURFACES

(75) Inventors: Dan Brunedal, Goteberg (SE); Patrick Smith, Raleigh, NC (US)

(73) Assignee: Pergo (Europe) AB, Trelleborg (SE)

( * ) Notice: Subject to any disclaimer, the term of this patent is extended or adjusted under 35 U.S.C. 154(b) by 987 days.

(21) Appl. No.: 11/907,965

(22) Filed: Oct. 18, 2007

(65) Prior Publication Data

US 2008/0168729 A1 Jul. 17, 2008

Related U.S. Application Data

(60) Provisional application No. 60/852,418, filed on Oct. 18, 2006.

(51) Int. Cl.

| | |
|---|---|
| ***E04F 13/00*** | (2006.01) |
| ***E04F 15/00*** | (2006.01) |
| ***E04F 19/00*** | (2006.01) |
| ***E04C 1/00*** | (2006.01) |
| ***B44F 7/00*** | (2006.01) |
| ***B44F 9/00*** | (2006.01) |

(52) U.S. Cl.
USPC ..... 52/312; 52/311.1; 52/311.2; 52/313; 52/314; 52/316

(58) Field of Classification Search
USPC ..... 52/311.1, 311.2, 311.3, 312, 313, 52/314, 316, 459, 462, 464, 466, 468, 471
See application file for complete search history.

(56) References Cited

U.S. PATENT DOCUMENTS

| | | | |
|---|---|---|---|
| 1,357,713 | A | 11/1920 | Lane |
| 1,576,527 | A | 3/1926 | McBride |
| 1,736,539 | A | 11/1929 | Lachman |
| 1,942,137 | A | 1/1934 | Connell et al. |
| 1,966,020 | A | 7/1934 | Rowley |
| 2,100,238 | A | 11/1937 | Burgess |
| 2,194,086 | A | 3/1940 | Horn |

(Continued)

FOREIGN PATENT DOCUMENTS

| | | |
|---|---|---|
| BE | 1010487 | 10/1998 |
| CA | 991373 | 6/1976 |

(Continued)

OTHER PUBLICATIONS

Encyclopedia Of Chemical Technology, 3rd Edition, vol. 23, "Thyroid and Antithyroid Preparations To Vinyl Polymers", 1983, John Wiley & Sons; USA.

(Continued)

*Primary Examiner* — Mark Wendell
(74) *Attorney, Agent, or Firm* — Jenkins, Wilson, Taylor & Hunt, P.A.

(57) ABSTRACT

A structure to form flooring transitions having outer surfaces comprising two disparate materials. In a preferred embodiment the flooring transitions includes a T-shaped molding and at least one attachment thereto. The outer surfaces of the T-molding and attachment may be comprised of different materials, even though they may sometimes have the same pattern or décor. For example, the T-molding may have a surface of real wood or veneer and the attachment may have an outer surface of abrasion resistant foil, metal, or even a visual perception element, such as lights or reflective tape. A kit is also disclosed.

19 Claims, 3 Drawing Sheets

U.S. PATENT DOCUMENTS 2,363,429 A 11/1944 Lowry
2,796,624 A 6/1957 Speer
2,926,401 A 3/1960 Place
2,996,751 A 8/1961 Roby et al.
3,028,938 A 4/1962 Wallace
3,162,906 A 12/1964 Dudley
3,199,258 A 8/1965 Jentoft
3,286,425 A 11/1966 Brown
3,296,056 A 1/1967 Bechtold
3,331,171 A 7/1967 Hallock
3,339,329 A 9/1967 Berg
3,362,127 A 1/1968 McGowan
3,363,381 A 1/1968 Forrest
3,363,382 A 1/1968 Forrest
3,411,977 A * 11/1968 Slater, Jr. ..... 428/33
3,435,574 A 4/1969 Hallock
3,488,828 A 1/1970 Gallagher
3,508,369 A 4/1970 Tennison
3,543,326 A 12/1970 Rohrberg
3,570,205 A 3/1971 Payne
3,665,666 A 5/1972 Delcroix
3,667,177 A 6/1972 Biela
3,670,470 A 6/1972 Thom
3,671,369 A 6/1972 Kvalheim
3,696,461 A 10/1972 Kelly
3,696,575 A 10/1972 Armstrong
3,745,726 A 7/1973 Thom et al.
3,758,650 A 9/1973 Hurst
3,760,544 A 9/1973 Hawes et al.
3,810,707 A 5/1974 Tungseth et al.
3,953,661 A 4/1976 Gulley
D240,221 S 6/1976 Hinze
4,059,933 A 11/1977 Funk
4,067,155 A 1/1978 Ruff
4,198,455 A 4/1980 Spiro et al.
4,244,102 A 1/1981 Bolles
4,292,774 A 10/1981 Mairle
4,445,306 A 5/1984 Schauffele
4,455,803 A 6/1984 Kornberger
4,461,131 A 7/1984 Pressell
4,474,197 A 10/1984 Kinoshita
4,504,347 A 3/1985 Munk et al.
4,520,062 A 5/1985 Ungar
4,594,347 A 6/1986 Ishikawa
4,643,237 A 2/1987 Rosa
4,653,138 A 3/1987 Carder
4,736,563 A 4/1988 Bilhorn
4,747,197 A 5/1988 Charron
4,757,657 A 7/1988 Mitchell
4,806,435 A 2/1989 Athey
4,833,956 A 5/1989 Roberts
4,893,449 A 1/1990 Kemper
4,940,503 A 7/1990 Lindgren
5,034,272 A 7/1991 Lindgren
5,074,089 A 12/1991 Kemmer et al.
5,155,952 A 10/1992 Herwegh et al.
5,288,540 A 2/1994 Albrinck et al.
5,365,713 A 11/1994 Nicholas
5,451,451 A 9/1995 Minnick
5,469,666 A 11/1995 Lewis, Jr.
D373,203 S 8/1996 Kornfalt
5,581,967 A 12/1996 Glatz
5,638,653 A 6/1997 Rossi
5,653,072 A 8/1997 Seelandt-Stasek et al.
5,657,598 A 8/1997 Wilbs et al.
5,688,569 A 11/1997 Gilmore
5,695,875 A 12/1997 Larsson
5,706,623 A 1/1998 Brown
5,769,562 A 6/1998 Jones
5,888,017 A 3/1999 Corrie
5,937,612 A 8/1999 Winer et al.
5,939,670 A 8/1999 Shteynberg et al.
6,073,408 A 6/2000 Winer et al.
6,093,473 A 7/2000 Min
6,115,975 A 9/2000 Abdollahi
6,134,854 A 10/2000 Stanchfield
6,141,920 A 11/2000 Kemper
6,148,584 A 11/2000 Wilson
6,158,915 A 12/2000 Kise
6,219,982 B1 4/2001 Eyring
6,230,385 B1 5/2001 Nelson
6,230,410 B1 5/2001 Taylor et al.
6,253,514 B1 7/2001 Jobe
6,298,561 B1 10/2001 Decker
6,345,480 B1 2/2002 Kemper et al.
6,360,500 B1 3/2002 Wilcox
6,421,970 B1 7/2002 Martensson et al.
6,517,935 B1 2/2003 Kornfalt et al.
6,536,178 B1 3/2003 Palsson et al.
6,550,192 B1 4/2003 Nelson et al.
6,550,205 B2 4/2003 Neuhofer, Jr.
6,560,944 B1 5/2003 Wilson
6,588,165 B1 * 7/2003 Wright ..... 52/506.05
6,591,568 B1 7/2003 Palsson
6,606,827 B1 8/2003 Hoffmann
6,647,680 B2 11/2003 Daly et al.
6,745,534 B2 6/2004 Kornfalt
6,805,951 B2 10/2004 Kornfalt
6,823,638 B2 11/2004 Stanchfield
6,860,074 B2 * 3/2005 Stanchfield ..... 52/464
D504,181 S 4/2005 Stanchfield
D504,730 S 5/2005 Kornfalt et al.
D504,731 S 5/2005 Stanchfield
D505,211 S 5/2005 Stanchfield
6,898,911 B2 5/2005 Kornfalt
6,964,075 B1 11/2005 Iannacone, Jr.
6,988,345 B1 1/2006 Pelfrey et al.
6,991,830 B1 1/2006 Hansson
7,003,364 B1 2/2006 Hansson
7,029,741 B2 4/2006 Sjoberg
7,037,024 B2 5/2006 Steinwender
7,065,931 B2 6/2006 Kornfalt
7,091,579 B2 8/2006 Nemoto
7,150,134 B2 12/2006 Kornfalt et al.
7,188,456 B2 3/2007 Knauseder
7,207,143 B2 4/2007 Stanchfield
D542,939 S 5/2007 Neuhofer, Jr.
D542,941 S 5/2007 Neuhofer, Jr.
7,287,357 B2 * 10/2007 Gomez Insa ..... 52/464
7,389,613 B2 6/2008 Sondermann
7,441,384 B2 10/2008 Miller et al.
7,476,351 B2 1/2009 Nilsson et al.
7,559,177 B2 7/2009 Stanchfield
7,640,705 B2 1/2010 Kornfalt et al.
7,640,706 B2 1/2010 Stanchfield
7,644,553 B2 1/2010 Knauseder
7,735,283 B2 6/2010 Stanchfield
7,784,237 B2 8/2010 Stanchfield
7,793,483 B2 9/2010 Stanchfield et al.
7,814,720 B2 10/2010 Neuhofer
7,820,287 B2 10/2010 Kornfalt
7,862,670 B2 1/2011 Hansson et al.
7,908,819 B2 3/2011 Neuhofer, Jr.
8,122,665 B2 2/2012 Stanchfield et al.
8,205,410 B2 6/2012 Stanchfield
8,327,595 B2 12/2012 Stanchfield
2001/0037617 A1 11/2001 Chi
2002/0025446 A1 * 2/2002 Chen et al. ..... 428/543
2002/0108323 A1 8/2002 Gruber
2002/0127374 A1 9/2002 Spratling
2003/0084634 A1 5/2003 Stanchfield
2003/0141004 A1 7/2003 Palmblad et al.
2003/0207083 A1 11/2003 Hansson et al.
2005/0166526 A1 8/2005 Stanchfield
2006/0201093 A1 9/2006 Stanchfield
2007/0107344 A1 5/2007 Kornfalt et al.
2007/0125021 A1 6/2007 Thiers et al.
2007/0283654 A1 12/2007 Stanchfield et al.
2008/0034696 A1 2/2008 Neuhofer
2008/0263983 A1 10/2008 Stanchfield et al.
2010/0242393 A1 9/2010 Kornfalt
2012/0272602 A1 11/2012 Stanchfield et al.
2012/0324817 A1 12/2012 Stanchfield

FOREIGN PATENT DOCUMENTS

DE 2159042 11/1971
DE 2238660 2/1974

| | | |
|---|---|---|
| DE | 2502992 | 1/1975 |
| DE | 2638518 | 3/1977 |
| DE | 3041781 | 6/1982 |
| DE | 3343601 | 2/1983 |
| DE | 3544845 | 6/1987 |
| DE | 3640822 | 6/1988 |
| DE | 3932980 | 3/1989 |
| DE | 29600057 | 4/1996 |
| DE | 29618803 | 2/1997 |
| DE | 29703962 | 4/1997 |
| DE | 19951516 | 10/1999 |
| DE | 19821938 | 11/1999 |
| DE | 29920645 | 3/2000 |
| DE | 20100413 | 4/2002 |
| DE | 10131248 | 1/2003 |
| EP | 1111155 | 12/1999 |
| EP | 0788576 | 9/2000 |
| EP | 1310613 | 5/2003 |
| FR | 2 268 922 | 11/1975 |
| GB | 424057 | 2/1935 |
| GB | 812671 | 4/1959 |
| GB | 1348272 | 4/1971 |
| GB | 1430423 | 5/1974 |
| GB | 2088280 | 6/1982 |
| GB | 2096665 | 10/1982 |
| GB | 2117813 | 10/1983 |
| GB | 2141457 | 12/1984 |
| GB | 2256023 | 11/1992 |
| JP | 3169967 | 7/1991 |
| SE | 467150 | 6/1992 |
| SE | 501014 | 10/1994 |
| SE | 502994 | 3/1996 |
| SE | 503861 | 9/1996 |
| SE | 9904533 | 6/2001 |
| SE | 517353 | 5/2002 |
| WO | WO 93/13280 | 7/1993 |
| WO | WO 94/01628 | 1/1994 |
| WO | WO 94/26999 | 11/1994 |
| WO | WO 9612857 | 5/1996 |
| WO | WO 96/27719 | 9/1996 |
| WO | WO 9731775 | 9/1997 |
| WO | WO 9731776 | 9/1997 |
| WO | WO 9822678 | 5/1998 |
| WO | WO 99/01628 | 1/1999 |
| WO | WO 99/66151 | 12/1999 |
| WO | WO 0014351 | 3/2000 |
| WO | WO 01/20101 | 3/2001 |
| WO | WO 0131141 | 5/2001 |
| WO | WO 01/42589 | 6/2001 |
| WO | WO 0240809 | 5/2002 |
| WO | WO 03/016657 | 2/2003 |
| WO | WO 03040492 | 5/2003 |
| WO | WO 03093686 | 11/2003 |
| WO | WO 2005/083195 | 2/2004 |
| WO | WO 2005/049938 | 6/2005 |
| WO | WO 2005/059269 | 6/2005 |
| WO | WO 2005/065381 | 7/2005 |
| WO | WO 2005/083196 | 9/2005 |
| WO | WO 2005/116364 | 12/2005 |
| WO | WO 2005/122667 | 12/2005 |
| WO | WO 2006/093866 | 9/2006 |

OTHER PUBLICATIONS

Sweets Catalog File, Products for General Building and Renovation; McGraw Hill Information Systems Co.; Feb. 1986, pp. 18-19.
Time Life Catalog; pp. 1-35; 1994.
"Wood Flooring," Floors, Stairs & Carpets, Time Life Books , Inc., Jan. 1994, p. 14.
Fix it Yourself, Floors, Stairs, & Carpets. Time Life Books, St. Remy Press, ISBN0-376-01909-3, pp. 14-35, Jan. 1994.
Vila, Bob, Bob Vila's Workshop: The Ultimate Illustrated Handbook for the Home Workshop, William Morrow and Company, Inc., published Oct. 5, 1994, pp. 107-112.
Magazin Parkett; Feb. 1995.
International Search Report of PCT/SE95/01206 dated Nov. 21, 1995.
Marcarena Flooring; Formica Corporation 1998.
Final Office Action for U.S. Appl. No. 08/817,391 dated Jul. 8, 1998.
Examiner Interview Summary for U.S. Appl. No. 08/817,391 dated Dec. 9, 1998.
Formica Flooring Catalog; Formica Corporation 1999.
Pergo Original Catalog, Jan. 1999.
Notice of Allowance for U.S. Appl. No. 08/817,391 dated Nov. 6, 2002.
Search Report for PCT/IB02/04737 dated Dec. 3, 2003.
Non-final Office Action for U.S. Appl. No. 10/347,489 dated Feb. 18, 2004.
Non-final Office Action for U.S. Appl. No. 10/748,852 dated Feb. 18, 2004.
Non-Final Office Action for U.S. Appl. No. 10/319,820 dated Mar. 25, 2004.
Notice of Allowance for U.S. Appl. No. 10/360,802 dated Jul. 16, 2004.
Examiner Interview Summary for U.S. Appl. No. 10/360,802 dated Jul. 16, 2004.
Final Office Action for U.S. Appl. No. 10/319,820 dated Jul. 26, 2004.
Notice of Allowance for U.S. Appl. No. 10/347,489 dated Aug. 23, 2004.
Notice of Allowance for U.S. Appl. No. 10/748,852 dated Aug. 23, 2004.
Notice of Allowance for U.S. Appl. No. 10/319,820 dated Nov. 4, 2004.
Notice of Allowance for U.S. Appl. No. 29/208,500 dated Dec. 2, 2004.
Supplemental Notice of Allowance for U.S. Appl. No. 10/319,820 dated Mar. 9, 2005.
Non-Final Office Action for U.S. Appl. No. 10/902,062 dated Apr. 5, 2005.
Final Office Action for U.S. Appl. No. 10/902,062 dated Nov. 28, 2005.
Notice of Allowance for U.S. Appl. No. 10/902,062 dated Mar. 15, 2006.
Non-Final Office Action for U.S. Appl. No. 11/140,075 dated Apr. 28, 2006.
Non-final Office Action for U.S. Appl. No. 11/343,199 Jul. 10, 2006.
Search Report Dated Aug. 9, 2006.
International Search Report dated Aug. 22, 2006.
Notice of Allowance for U.S. Appl. No. 11/140,075 dated Sep. 14, 2006.
Notice of Allowance for U.S. Appl. No. 11/343,199 dated Dec. 14, 2006.
Non-Final Office Action for U.S. Appl. No. 11/640,351 dated Jun. 26, 2007.
Non-Final Office Action for U.S. Appl. No. 11/785,176 dated Sep. 17, 2007.
Final Office Action for U.S. Appl. No. 11/640,351 dated Dec. 13, 2007.
Non-Final Office Action for U.S. Appl. No. 11/785,176 dated Mar. 26, 2008.
Non-final Office Action for U.S. Appl. No. 11/785,174 dated Jul. 10, 2008.
Examiner Interview Summary for U.S. Appl. No. 11/640,351 dated Jul. 23, 2008.
Non-Final Office Action for U.S. Appl. No. 11/640,351 dated Aug. 12, 2008.
Non-final Office Action for U.S. Appl. No. 11/066,099 dated Sep. 15, 2008.
Non-Final Office Action for U.S. Appl. No. 10/895,329 dated Oct. 8, 2008.
Final Office Action for U.S. Appl. No. 11/785,176 dated Nov. 10, 2008.
International Search Report, Nov. 10, 2008.
Final Office Action for U.S. Appl. No. 11/066,099 dated Apr. 14, 2009.
Final Office Action for U.S. Appl. No. 11/640,351 dated Apr. 22, 2009.
Non-Final Office Action for U.S. Appl. No. 11/400,519 dated Apr. 24, 2009.

Non-Final Office Action for U.S. Appl. No. 11/785,176 dated May 28, 2009.
Advisory Action for U.S. Appl. No. 11/066,099 dated Aug. 14, 2009.
Notice of Allowance for U.S. Appl. No. 11/400,519 dated Aug. 24, 2009.
Final Office Action for U.S. Appl. No. 10/895,329 dated Sep. 16, 2009.
Final Office Action for U.S. Appl. No. 11/785,174 dated Oct. 28, 2009.
Non-Final Office Action for U.S. Appl. No. 11/785,176 dated Nov. 24, 2009.
Notice of Allowance for U.S. Appl. No. 11/785,174 dated Feb. 16, 2010.
Notice of Allowance for Application U.S. Appl. No. 11/066,099 dated Feb. 18, 2010.
Notice of Allowance for U.S. Appl. No. 10/895,329 dated Jun. 25, 2010.
Non-Final Office Action for U.S. Appl. No. 11/785,176 dated Jun. 29, 2010.
Non-Final Office Action for U.S. Appl. No. 11/984,091 dated Jul. 7, 2010.
Office Action/Restriction Requirement for U.S. Appl. No. 12/787,199 dated Oct. 25, 2010.
Supplemental European Search Report dated Nov. 19, 2010.
Final Office Action for U.S. Appl. No. 11/984,091 dated Nov. 23, 2010.
Non-Final Office Action for U.S. Appl. No. 11/785,176 dated Jan. 6, 2012.
Final Office Action for U.S. Appl. No. 11/785,176 dated Jan. 20, 2011.
Non-final Office Action for U.S. Appl. No. 12/787,199 dated Jan. 21, 2011.
Notice of Allowance for U.S. Appl. No. 12/787,199 dated Feb. 27, 2012.
Non-Final Office Action for U.S. Appl. No. 12/731,645 dated Mar. 27, 2012.
Examination Report for European Application Serial No. EP 04815942 dated Apr. 23, 2012.
Examiner Interview Summary for U.S. Appl. No. 11/785,176 dated Jul. 2, 2012.
Notice of Allowance for U.S. Appl. No. 11/785,176 dated Aug. 6, 2012.
Final Office Action for U.S. Appl. No. 12/731,645 dated Aug. 24, 2012.
Non-Final Office Action for U.S. Appl. No. 13/532,590 dated Nov. 28, 2012.
Non-Final Office Action for U.S. Appl. No. 12/731,645 dated Dec. 4, 2012.
Non-Final Office Action for U.S. Appl. No. 13/532,590 dated Jan. 25, 2013.
Notice of Allowance for U.S. Appl. No. 11/640,351 dated Feb. 4, 2013.

* cited by examiner

TRANSITIONS HAVING DISPARATE SURFACES

CROSS REFERENCE TO RELATED APPLICATIONS

This application claims benefit under 35 U.S.C. 119 of U.S. Provisional Application Ser. No. 60/852,418 filed Oct. 18, 2006, the entire disclosure of which are hereby incorporated by reference its entirety.

BACKGROUND

1. Field of the Invention

The invention relates to a structure which can be used to form flooring transitions such as T-moldings, hard surface reducers and end moldings, between or adjacent to flooring elements, comprising at least two different materials on the decorative outer surfaces.

2. Background of the Invention

Multifunctional moldings for floors are known in the art, such as described by U.S. Pat. No. 6,860,074, the entire disclosure of which is herein incorporated by reference. Typically, such multifunctional moldings include a first molding element, generally a T-molding, and a second molding element. The first molding element and second molding element are typically connected by a tongue-and-groove joint, adhesive or other mechanical means. Due to the size and shape of the second molding element, when the second molding element is joined to the first molding, element, the assembly forms, for example, a carpet reducer/end molding (sometimes referred to in the art as a "square nose" molding), a hard surface reducer, or a stair nose.

According to one embodiment the present invention the decorative outer surface of the first molding element (or T-molding) is a wood veneer and the decorative outer surface of the other structures, typically the second molding element, is a foil. While foils typically have abrasion resistances substantially less than similar veneer constructions, because the decorative outer surface of the attached molding piece is not subject to significant abrasion due to its shape and position, the present inventors have discovered that when the T-molding is formed from wood veneer, the decorative outer surface of the second molding element can be, instead of a similar wood veneer, a foil. Such a construction reduces cost upwards of 20% when compared to all veneer products.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
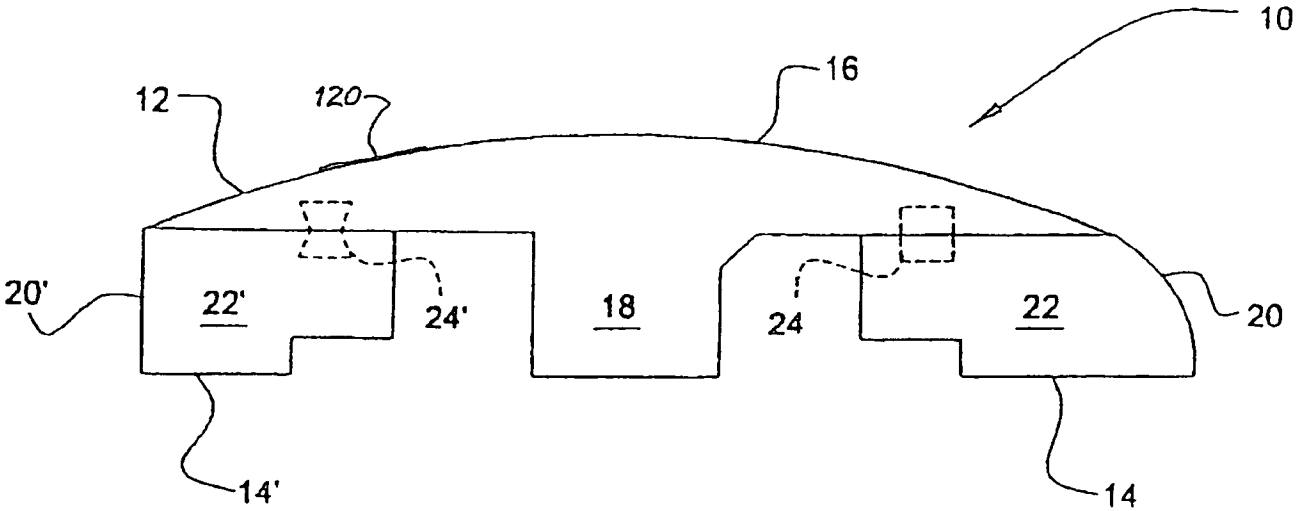
FIG. 1 shows the assembly of the invention, including both a carpet reducer/end molding and a hard surface reducer.

FIG. 1 shows an assembled view of the various parts of the inventive joint cover assembly 10. The assembly 10 includes a T-molding 12. As the overall shape of the T-molding 12 is conventional in the art, and can be readily understood by those of ordinary skill in the art from the drawings, further description is not provided herein.

Figure 2:
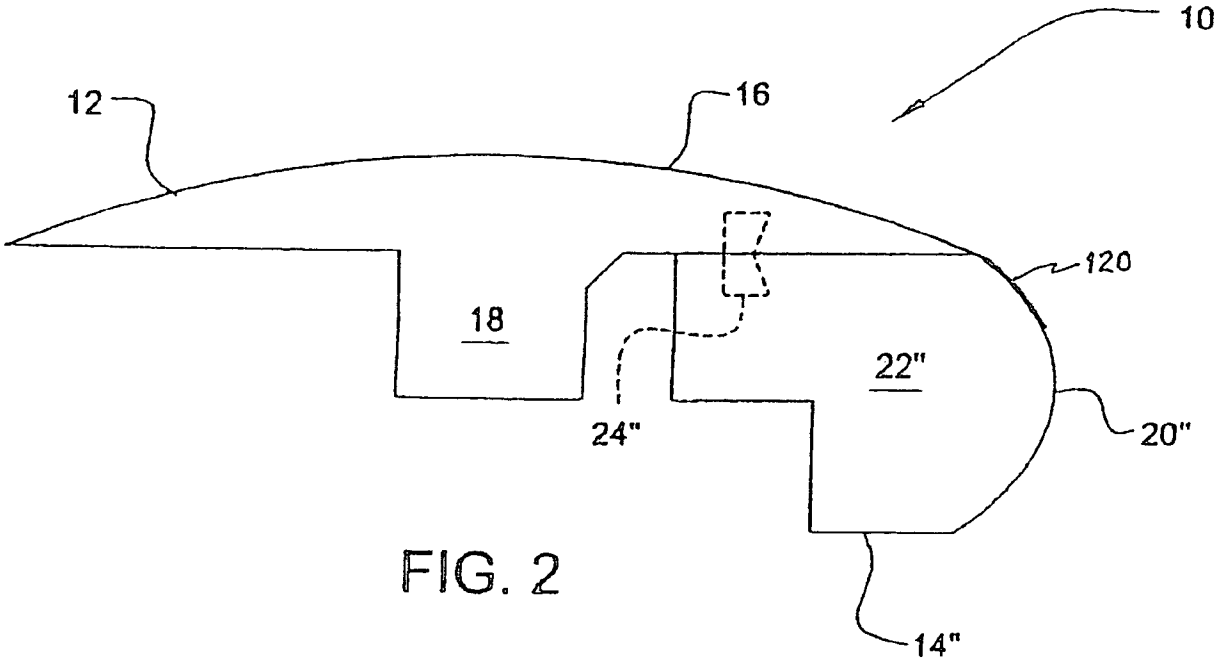
FIG. 2 shows the assembly of the invention, including a stair nose.
Figure 4:
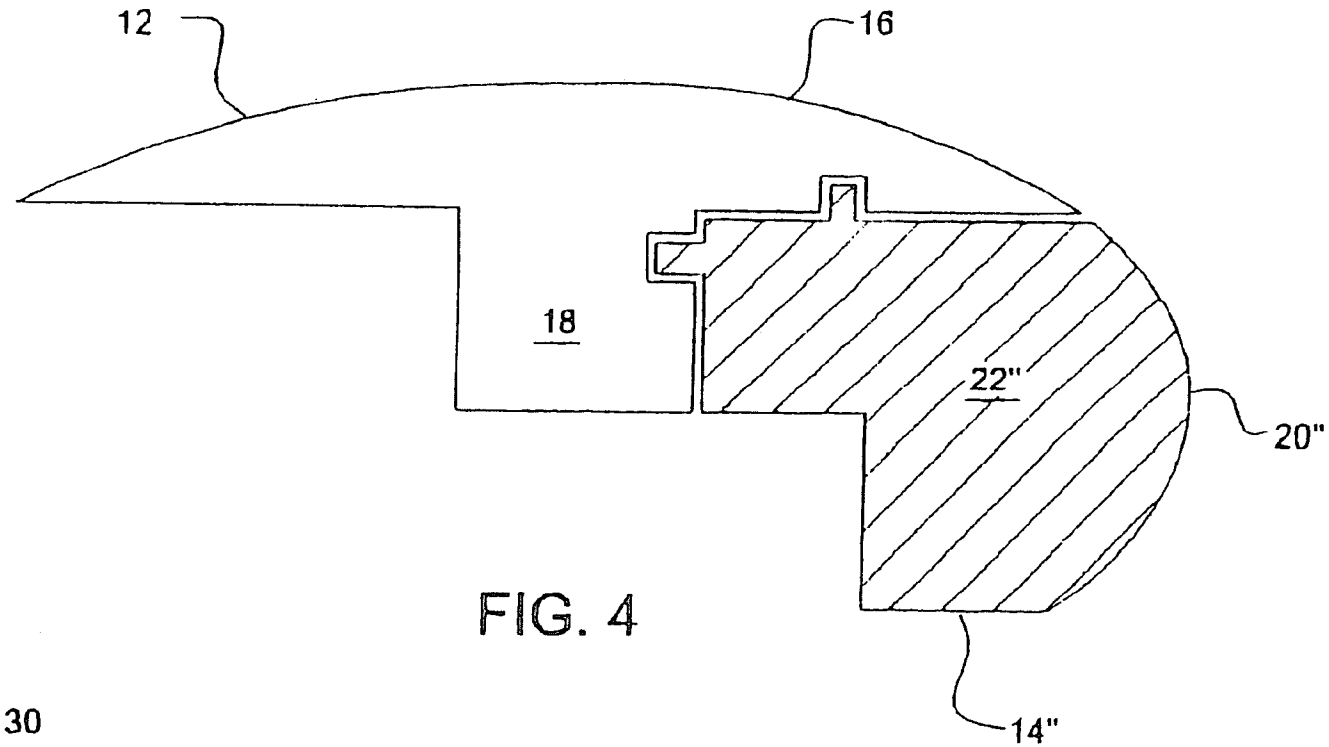
FIG. 4 shows an alternative embodiment of the invention, including a stair nose.
Figure 3:
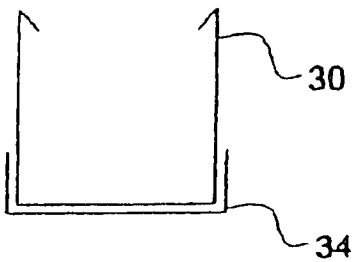
FIG. 3 shows a schematic of a shim and securing element of the invention.

The T-molding 12 is shown as being attached to two second molding elements, or attachments, specifically a hard surface attachment (HSA) 14 and an end molding/carpet attachment (EM) 14'. FIG. 2 (or the alternative embodiment of FIG. 4) shows the T-molding being attached to a different attachment, a stair nose attachment 14". Depending upon the desired functionality of the assembly, the T-molding 12 can be used with HSA 14, EM 14' and/or stair nose attachment 14" (collectively referred to herein as "attachments"). Because the attachments differ only in size and shape, for purposes of clarity only HSA 14 is discussed herein, but it should be understood that any discussion of HSA 14 is equally applicable to EM 14' and stair nose attachment 20" and the respective sub-elements as well. When installed, the assembly 10 may also include a securing element 30 to fasten the assembly 10 to a subfloor 32 (not shown) as well as one or more shims 34; see FIG. 3.

The attachments are typically joined to the T-molding via a joint 24. This mechanical joint can be a straight tongue-and-groove joint 24, a dove-tail joint 24', a half-dove tail joint 24" or any other type of mechanical joint. As the relative orientation of the joint, i.e., particular location of the tongue and groove, can be on either the T-molding 12 or the attachment, the joints 24 are shown as dotted lines to show that the locations of the tongue and groove can be inverted. However, it is considered within the scope of the invention to eliminate the mechanical joint 24 in favor of a chemical joint, e.g., adhesive, or using the securing element 30 as described by U.S. Pat. No. 6,860,074.

Each of the T-molding 12 and the attachments, i.e., the structural elements of the invention, are formed from a decorative surface (16 and 20, respectively) atop a core (18 and 22, respectively). As can be understood by the drawings, the T-molding 12 of the invention can have two arms or members extending substantially perpendicularly from a substantially downwardly extending foot. To install the T-molding 12, the foot is inserted into the securing element 30, with optionally the shim 34 positioned therebetween. The securing element 30, which may take the form of a clip, track or rail, can be secured to the subfloor by, for example, a screw, nail or adhesive. When installed, the assembly can accommodate flooring systems of a wide variety of heights, for example, on the order of between approximately 3 and approximately 30 mm, typically between approximately 5 and approximately 25 mm, more typically between approximately 10 and 25 mm, and most preferably between approximately 14 mm and approximately 20 mm.

The cores 18 and 22 typically include wood based products, such as high density fiberboard (HDF), medium density fiberboard (MDF), particleboard, strandboard, plywood, gypsum, high density fiber-reinforced plaster, and solid wood; polymer-based products, such as polyvinyl chloride (PVC), thermoplastics or thermosetting plastics or mixtures of plastic and other products, including reinforcements; and metals, such as aluminum, stainless steel, brass, aluminum or copper. The cores 18 and 22 do not necessarily have to be formed of the same material, although in some embodiments they are. For example, although cores 18 and 22 may each be formed of fiberboard, core 18 can be formed of metal and core 22 formed of wood, fiberboard or other wood based product or even plastic. It is to be understood that the surface 16 of the T-molding can sometimes be the top of the core material, such as metal and yet the surface 20 and 20' can be foil, veneer or laminate, or vice versa, that is to say the surface 16 may be a veneer or laminate and the surface 20 and 21', which may be the same or different, be formed of a metal, an abrasion resistant foil, laminate, veneer or natural wood.

According to another embodiment of the invention, the surface 16 is a veneer, such as a wood veneer, being one or more thin layers of natural wood, while the surface 20 is formed from a foil. Preferably, the décor of the foil at least matches with the image/pattern of the veneer. For example, the foil may simply be made to visually and textually depict the same wood the veneer is made from. Alternatively the surface 16 can be administer such as a direct laminate (DL) or high pressure laminate *HPL) on the T-molding and a foil appears on the other surfaces 20 and/or 20'.

Suitable foils are thin sheets of thermosetting (e.g., melamine formaldehyde) or thermoplastic plastic (e.g., polyvinyl chloride) material having a decorative surface. The decorative surface can be a typically impregnated décor sheet or can be applied directly on the surface of the foil itself, for example, by printing rolling or by a brush. The foil may also take the form of a printed paper, impregnated with, for example, an acrylic resin.

Suitable foils can have an abrasive resistance at least equivalent to AC1, AC2, AC3, AC4 and/or AC5, as defined by the European Laminate Flooring Association. Such foils may also include hard particles to impart abrasion and/or scratch resistance as is known in the art. Suitable hard particles can include alumina, silicon carbide, silicon nitride and diamond, as well as other particles having a Moh's hardness of at least approximately 6, of sizes and distributions known in the art to impart scratch and/or abrasion resistance to similar products. In some embodiment the hardness of the particles may be less than approximately 6, such as 2, 3, 4 or 5 Moh's hardness depending on the desired application and desired properties.

In some embodiments of the invention, it may be desirable to include accent strips which can be integrated with the attachments or even into the T-molding. These accent strips 120 are usually intended for aesthetic purposes, e.g., of a different color or pattern to the wood veneer, natural wood, and/or foil. However, in some instances the intended purpose may be one of visual perception, such as guiding, safety, warning or other condition and may include light reflective particles or tape, may include lights, such as LED's for message, warning, or safety lighting. Additional accent strips or features could have different or the same abrasion ratings, even if identical in pattern or decor.

The invention additionally includes packaging to be used by, for example, wholesalers or retailers. In one embodiment, multiple individual pieces, e.g., T-molding 12, one or more attachments, a securing element 30 and one or more shims 34 may be bundled in a single package or kit. In another embodiment, the package or kit includes two, or three, or even up to twenty or more, of each piece packaged therein. For example, a single package may include three approximately one-meter (or three foot) sections of each item contained therein, for a total length of about three meters (about nine feet). It is additionally within the scope of the invention to include different sets of items in a single package, for example, one set being about one meter (about three feet) long and an additional set being about two meters (about six feet) long.

Additionally, as described herein, the moldings of the invention are designed to be used in the construction and/or assembly of a floor. Such floors can be found in homes (e.g., single family homes, condominiums, and apartment buildings), public establishments (e.g., shopping malls, restaurants, department stores, luxury areas of stadiums and arenas, and other stores), private businesses (reception or other areas of office buildings and warehouses). Utilization of the moldings as described herein provide significant added benefits in cost, performance and installation ease when compared to conventional moldings.

It should be apparent that embodiments other than those specifically described above may come within the spirit and scope of the present invention. Hence, the present invention is not limited by the above description.

We claim:

1. A flooring transition comprising a molding and an attachment thereto said molding including a foot and two generally opposing arms representing the shape of a T; and at least one attachment, the attachment being connected to at least one of the opposing arms or the foot;

said molding having an outer surface presenting at least one decorative surface selected from the group consisting of real wood, laminate, veneer and metal;

said attachment also having at least one outer decorative surface comprising an abrasion resistant foil; wherein the abrasion resistance of the foil is less than an abrasion resistance of the outer surface of the molding, wherein the foil contains hard particles having a Moh's hardness of at least 6.

2. The flooring transition of claim 1, wherein the molding and attachment are joined by a tongue and groove connection.

3. The flooring transition of claim 2, wherein there are at least two tongue and groove connections, one between the attachment and at least one of the opposing arms, and one between the foot and the attachment.

4. The flooring transition of claim 2, wherein the tongue and groove connection comprises a tongue on the opposing arm and a groove on the attachment.

5. The flooring transition of claim 1, wherein the molding and attachment are joined by an adhesive.

6. A kit comprising the flooring transition of claim 1, and at least one additional attachment, said at least one additional attachment differing in shape from the attachment of the flooring transition.

7. The kit of claim 6, further comprising a securing element.

8. The kit of claim 7, further comprising a shim.

9. The flooring transition of claim 1, further comprising a securing element.

10. The flooring transition of claim 9, wherein the attachment and molding are held in a predetermined spatial relationship by said securing element.

11. The flooring transition of claim 1, further comprising an accent strip integrated into at least one of the molding or attachment.

12. The flooring transition of claim 1, further including at least a visual perception element.

13. The flooring transition of claim 12, wherein the visual perception element is a light.

14. The flooring transition of claim 1, wherein the foil comprises a plastic material.

15. The flooring transition of claim 14, wherein the plastic material comprises a thermosetting or thermoplastic plastic material.

16. A flooring transition comprising a molding and an attachment thereto said molding including a foot and two generally opposing arms representing the shape of a T; and at least one attachment, the attachment being connected to at least one of the opposing arms or the foot;

said molding having an outer surface presenting at least one decorative surface selected from the group consisting of real wood, laminate, veneer and metal;

said attachment also having at least one outer decorative surface comprising an abrasion resistant foil;

wherein the abrasion resistance of the foil is less than an abrasion resistance of the outer decorative surface of the molding, wherein the foil contains hard particles having a Moh's hardness in the range of 2-6, wherein the outer decorative surface of the attachment visually and/or texturally matches the decorative surface of the molding.

17. The flooring transition of claim 16, wherein the foil comprises a plastic material.

18. The flooring transition of claim 17, wherein the plastic material comprises a thermosetting or thermoplastic plastic material.

19. A flooring transition comprising a molding and an attachment thereto said molding comprising a foot and two generally opposing arms representing the shape of a T, and at least one attachment, the attachment being connected to at least one of the opposing arms or the foot;

said molding having an outer surface presenting at least one decorative surface selected from the group consisting of real wood, laminate, veneer and metal;

said attachment also having at least one outer decorative surface comprising an abrasion resistant foil, wherein the foil comprises a plastic material, wherein the foil contains hard particles having a Moh's hardness of at least 6, wherein the outer decorative surface of the attachment visually and/or texturally matches the decorative surface of the molding.

* * * * *